US006209812B1

(12) United States Patent
Jokinen

(10) Patent No.: US 6,209,812 B1
(45) Date of Patent: Apr. 3, 2001

(54) METHOD OF AND APPARATUS FOR TREATING WOOD CHIPS

(75) Inventor: Mikko Jokinen, Luvia (FI)

(73) Assignee: BMH Wood Technology Oy, Rauma (FI)

( * ) Notice: Subject to any disclaimer, the term of this patent is extended or adjusted under 35 U.S.C. 154(b) by 0 days.

(21) Appl. No.: 09/353,570

(22) Filed: Jul. 15, 1999

Related U.S. Application Data

(63) Continuation of application No. PCT/FI98/00051, filed on Jan. 21, 1998.

(30) Foreign Application Priority Data

Jan. 22, 1997 (FI) ..... 970265

(51) Int. Cl.[7] ..... B02C 19/12

(52) U.S. Cl. ..... 241/81; 241/28; 241/135; 241/143

(58) Field of Search ..... 241/28, 81, 135, 241/143

(56) References Cited

U.S. PATENT DOCUMENTS

| | | | | |
|---|---|---|---|---|
| 3,622,089 | * | 11/1971 | Quinn | 241/81 |
| 4,050,980 | | 9/1977 | Schmidt et al. . | |
| 4,332,353 | | 6/1982 | Lario et al. . | |
| 4,953,795 | * | 9/1990 | Bielgaus . | |
| 5,385,309 | | 1/1995 | Bielagus . | |

FOREIGN PATENT DOCUMENTS

| | | |
|---|---|---|
| 208/63 | 9/1968 | (FI) . |
| 47390 | 11/1973 | (FI) . |
| 77699 | 4/1989 | (FI) . |
| 1542981 | 2/1990 | (SU) . |

* cited by examiner

*Primary Examiner*—Mark Rosenbaum
(74) *Attorney, Agent, or Firm*—Fish & Neave

(57) ABSTRACT

An apparatus for improving the pulping characteristics of wood chips. Several chip compressors are used to treat the wood chips in the desired manner.

6 Claims, 5 Drawing Sheets

METHOD OF AND APPARATUS FOR TREATING WOOD CHIPS

This application is a continuation of PCT/FI98/00051, filed Jan. 21, 1998.

BACKGROUND OF THE INVENTION

The invention relates to a method of and an apparatus for treating wood chips and in particular for improving the wood chips properties particularly in pulping processes of the pulp and paper industry. In said method the chips are divided into various fractions on the basis of a fragment size before any other treatment phases of the chips.

In pulping processes wood chips treating methods, in which over-thick (e.g. above 8 mm) chip fragments are separated from the wood chips by a screen and directed to be treated by a chip compressor, have been used for years. Known chip compressor structures are described, for example, in U.S. pat. Nos. 4,953,795 and 5,385,309, Finnish patent application (No.) 911 972 and Finnish utility model (No.) 2412. The chip compressor basically comprises two adjacent conveniently profiled rolls arranged to rotate in relation to parallel rotation axes. The chips to be treated are fed between the rolls.

Advantages gained by treating over-thick chips with compressors are thoroughly described, for example, in U.S. pat. No. 4,953,795. In brief, using compressor treatment the cooking properties of over-thick chips are improved to the level of accept-size chips.

BRIEF DESCRIPTION OF THE INVENTION

An object of the invention is to further develop the method in question and the apparatus implementing the method so that the cooking properties of the treated chips can further be improved. This object is achieved with the method and apparatus characterized by what is disclosed in the independent claims. The preferred embodiments of the invention are the subject of the dependent claims.

The basic idea of the invention is that accept-size chips, too, are treated by a compressor similar to the one previously employed only for treating over-thick chips. According to studies the cooking properties of accept chips, too, can further be significantly improved by compressor treatment.

An efficient but gentle compressor treatment of chip fragments of various sizes requires a nip, or the distance between press rolls, of various sizes and in some cases also a different profiling of roll surfaces, rotation speed and compressive force of the rolls. On this account a chip stream is divided into several fractions by a screen on the basis of the fragment size, whereupon each of the different fractions are directed to a specific chip compressor, whose nip, profiling, speed and compressive force are selected to suit this particular chip fraction.

Employing the method and apparatus according to the invention a more even cooking is achieved in the cooking process of the pulp, a higher total yield and a lower rejection level when cooking to the same kappa level compared with untreated chips or with chips from which only the over-thick fraction is treated.

BRIEF DESCRIPTION OF THE DRAWINGS

In the following the invention will be described in greater detail by means of the preferred embodiments with reference to the accompanying drawings, in which.

DETAILED DESCRIPTION OF THE INVENTION

Figure 1:
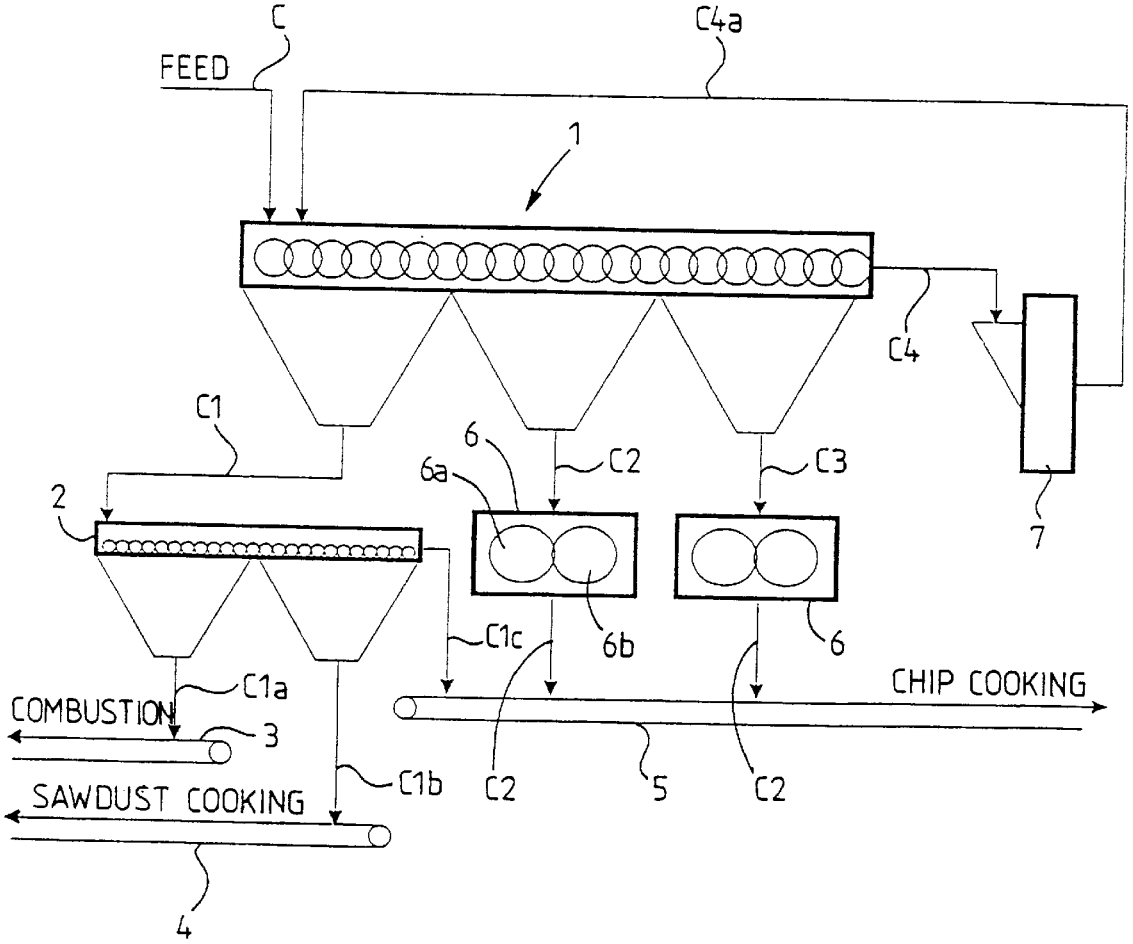
FIG. 1 is a diagram showing a preferred embodiment of a method and an apparatus according to the invention.

Referring to FIG. 1 chips C are at first fed to a disk screen 1, whose disk spacings and rotation speeds of disk axes are selected in such a manner that by using the screen 1 the following chip fractions are separated: a fraction C1 whose thickness is below 5 mm; a fraction C2 whose thickness is between 5–8 mm; a fraction C3 whose thickness is above 8 mm but whose length is below 45 mm; and a fraction C4 whose length is above 45 mm. The fraction C1 is then directed to a sawdust screen 2 by which for example a below 3 mm fraction C1*a* can further be separated from it for combustion (by a conveyor 3), a 3–5 mm fraction C1*b* for sawdust cooking (by a conveyor 4) and the remaining part C1*c* is directed to chip cooking (by a conveyor 5). The fraction C2 is directed to a chip compressor 6 comprising two adjacent rolls 6*a* and 6*b* arranged to rotate around parallel rotation axes and whose nip, profilings, rotation speeds and compressive force are so selected that an optimal treatment result is achieved given the fragment size of the fraction. Similarly the fraction C3 is directed to a corresponding chip compressor 6 whose said parameters are in turn selected to suite this fragment size. The fraction C4 is directed to a sliver chipper 7, whereupon it is returned to the beginning of the disk screen 1 as a, in fragment size, reduced fraction C4*a*.

Figure 2:
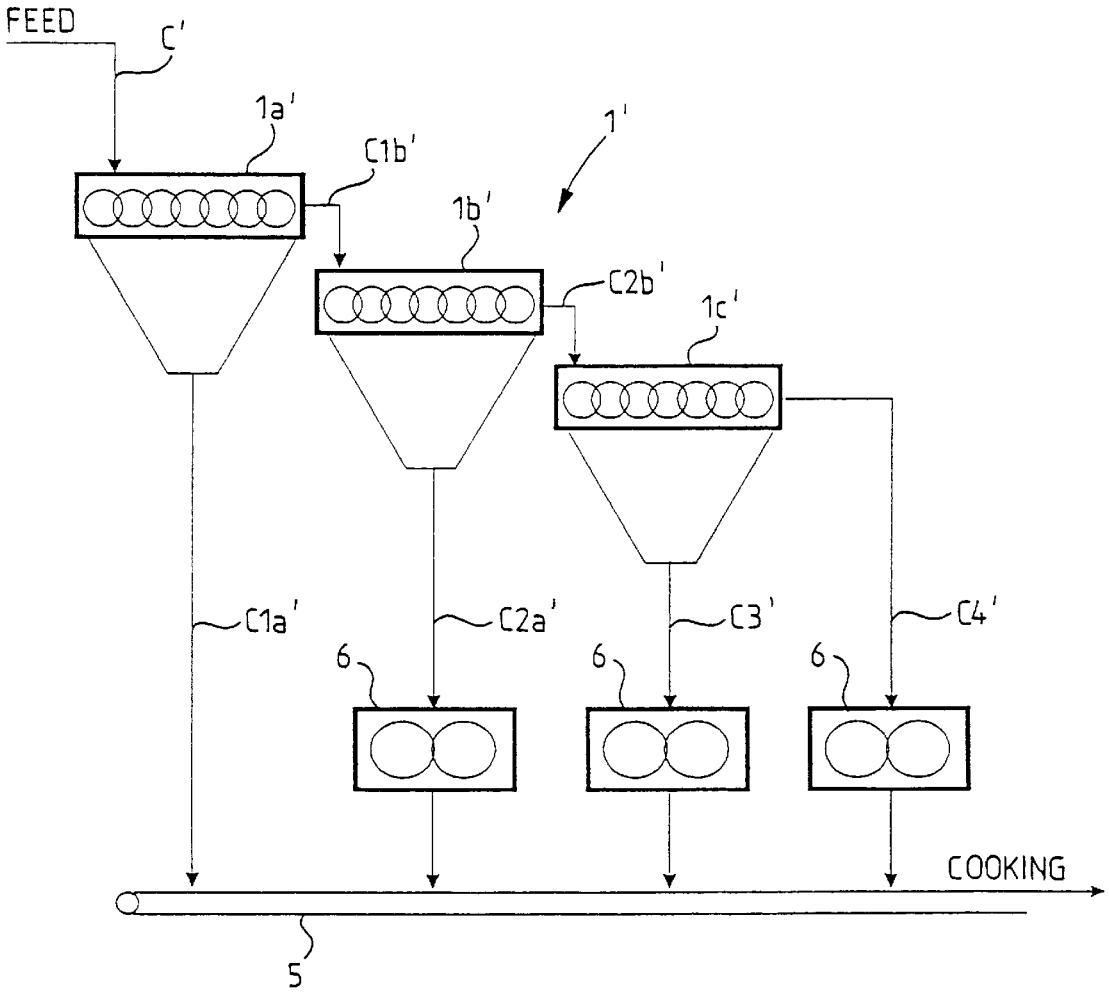
FIG. 2 is a diagram showing another preferred embodiment of a method and an apparatus according to the invention.

In the implementation according to FIG. 2 the chips C' from which sawdust and splints are separated, is at first fed into the first disk screen 1*a*' of the screening arrangement 1' dividing the chips into fractions which are below and above 4 mm in fragment size. The below 4 mm fraction C1*a*' is fed into the conveyor 5 leading directly to the chip cooking. The above 4 mm fraction C1*b*' is in turn fed into a second disk screen 1*b*', which is located lower than the first disk screen 1*a*', and divides said fraction into fractions below and above 6 mm. The below 6 mm fraction C2*a*' is then fed into the chip compressor 6, whose nip, profilings, speeds and compressive force are selected to suit the 4–6 mm chip fragments. The above 6 mm fraction C2*b*' is further fed into the next disk screen 1*c*' which is located lower than the second disk screen 1*b*' and divides said fraction into fractions below and above 8 mm. The below 8 mm fraction C3' is fed into the chip compressor 6 whose said parameters are selected to suit the 6–8 mm chip fragments. The above 8 mm fraction C4' is in turn fed into a third chip compressor 6, whose said parameters are selected to suit this fragment size. The chip streams treated by all three chip compressors are preferably gathered to the same conveyor 5 leading to the cooking into which the below 4 mm fraction C1*a*' is fed.

Figure 3:
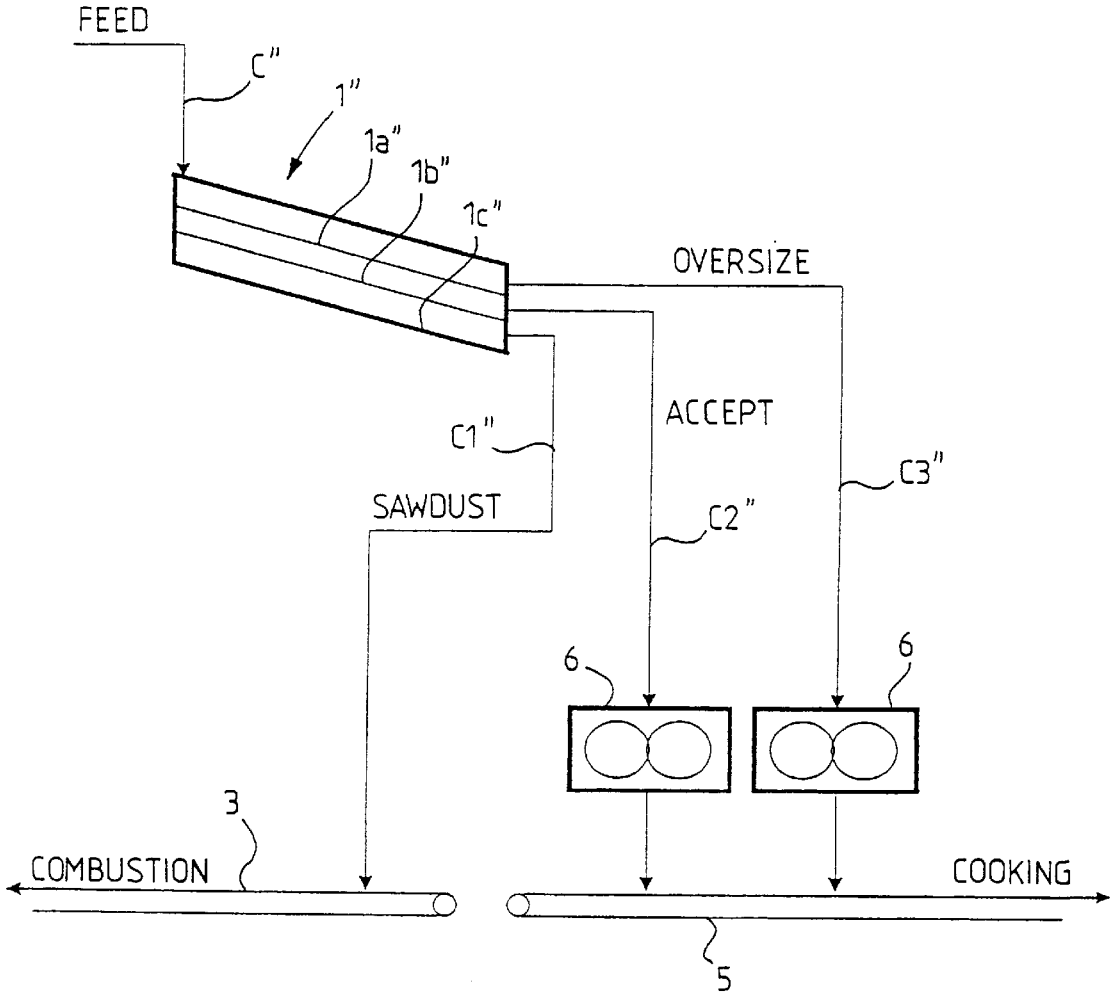
FIG. 3 is a diagram showing a further preferred embodiment of a method and an apparatus according to the invention.

In the third preferred implementation according to FIG. 3 the chips C" are at first fed into a flat screen 1" preferably having three levels. The chip fraction C3" (oversize fraction) that has remained above the highest screen disk 1*a*" is fed into a chip compressor, whose nip, profilings, speeds and compressive force are selected to suit this fraction. The chips C2" (accept fraction) that has remained above the middle screen level 1b" is fed into a second chip compressor 6 whose said parameters are in turn selected to suit this fraction.

The sawdust fraction C1" that has fallen into the lowest screen level 1*c*" is in turn gathered directly as fuel to the conveyor 3.

The above described screens 1, 1', 1", the sawdust screen 2 and the sliver chipper 7 are commonly of the prior art and will therefore not be further than above described here.

Figure 4:
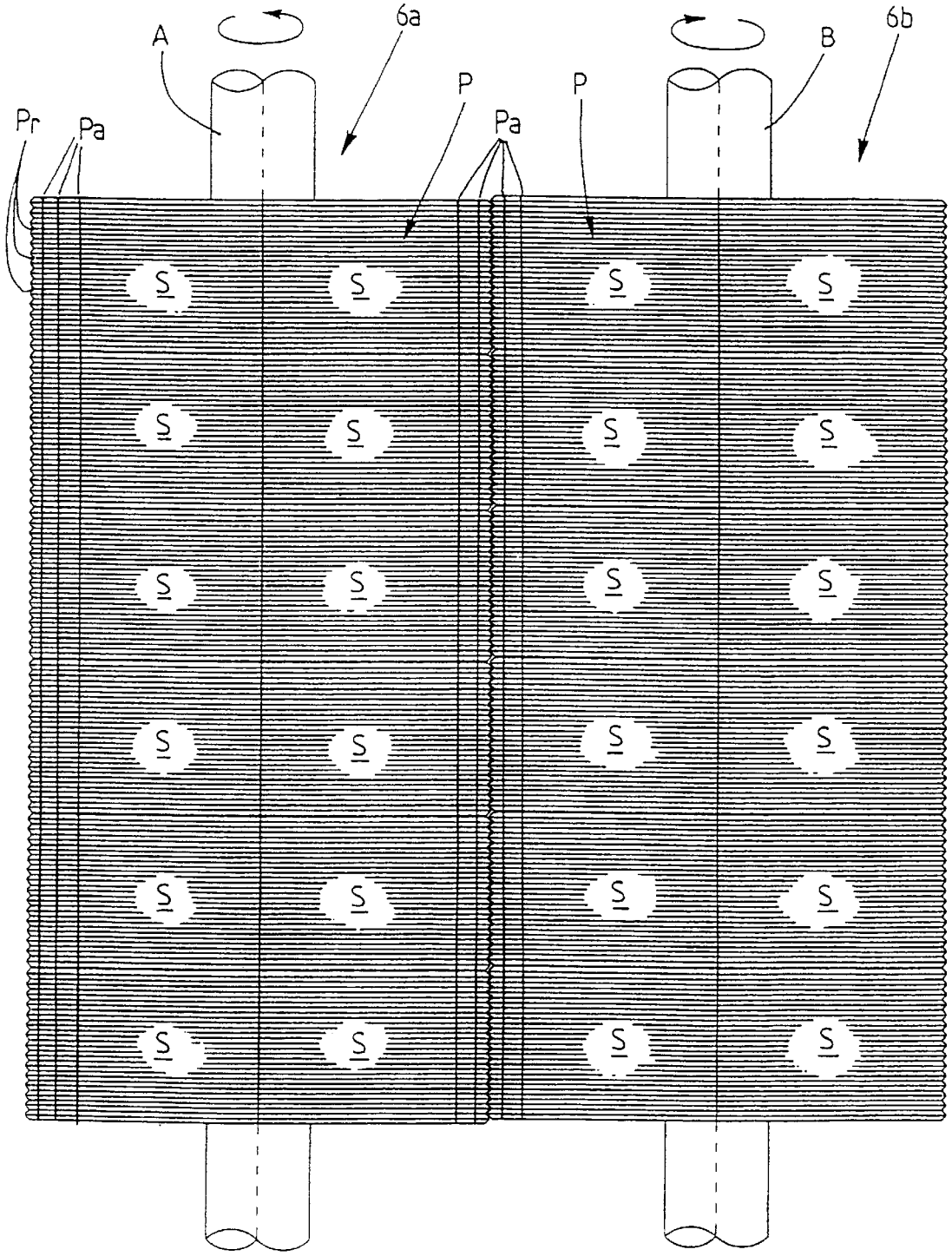
FIG. 4 shows a preferred roll arrangement of a chip compressor.
Figure 5:
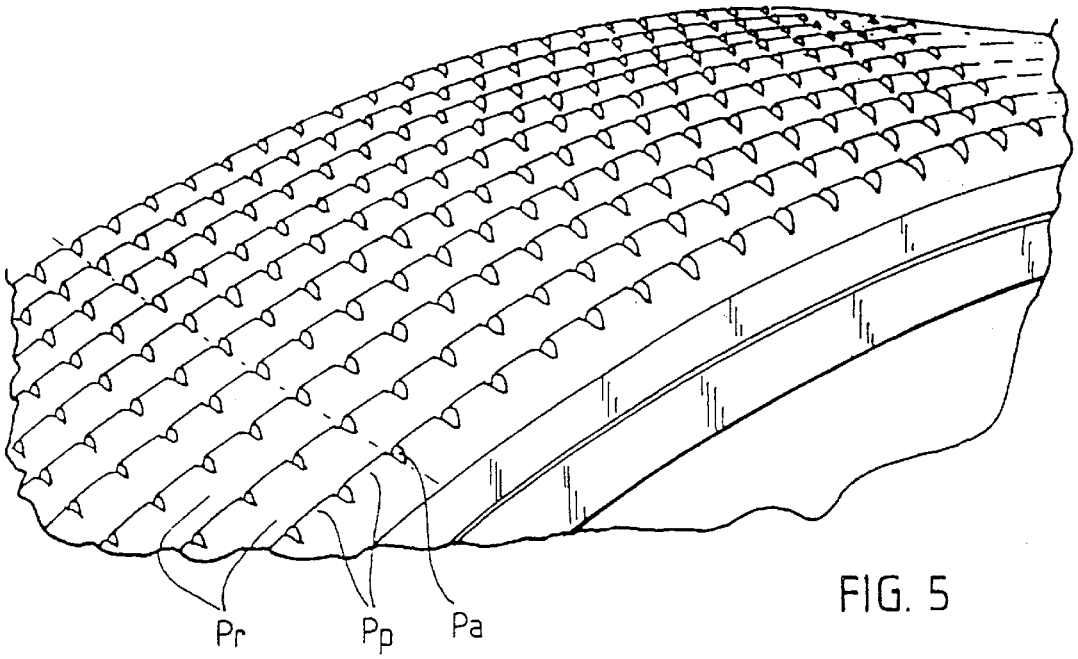
FIG. 5 shows a profile of the rolls shown in FIG. 4 in perspective and in enlarged scale.

Also the chip compressor 6 as such is of the prior art, but its preferred embodiment particularly applicable to the implementation of this invention is described in greater detail in FIGS. 4 and 5. The chip compressor 6 described in these Figures comprises two adjacent rolls 6*a* and 6*b* arranged to rotate around parallel rotation axes A and B. On the surface of both rolls 6*a* and 6*b* there is a profiling P comprising radial grooves Pr that form wave profiles on the surface of the rolls 6*a* and 6*b* and substantially axial grooves Pa that form notch rows to the wave profiles, whereby the profile peaks Pp of one roll 6*a* are located at the profile grooves Pr of the other roll. The distance between the two profile peaks Pp and the depth of the wave profile grooves Pr on each roll 6*a* and 6*b* and the adjustable distance between the rolls are selected to suit the respective chips C, C', C" passing through the rolls. Reference marks S describe the segments, by which the wave profiles are formed, attached to the jacket of the roll 6*a*, 6*b*. There is a more detailed description of this structure in said Finnish utility model (No.) 2412.

The invention has above been described only with reference to a few exemplary implementations. One skilled in the art can, however, implement the details of the invention in several alternative ways within the scope of the attached claims.

What is claimed is:

1. An apparatus for treating wood chips, comprising a screen (1; 1'; 1") for dividing the chips (C;C';C") into at least three different fractions on the basis of the fragment size, and at least two chip compressors (6) for treating the chip fractions separated by the screen, each chip compressor comprising two adjacent profile rolls (6*a*, 6*b*) arranged to rotate around parallel rotation axes (A,B) whereby the distances, or nips, between the rolls (6*a*, 6*b*) of the chip compressors (6) treating the different chip fractions are set to be of different sizes.

2. An apparatus as claimed in claim 1, characterized by comprising the screen (1) dividing the chips into four different fractions, a sliver hopper (7) or sliver crusher, two chip compressors (6) and a sawdust screen (2).

3. An apparatus as claimed in claim 1, characterized in that the screen (1') is divided into several parts (1*a*', 1*b*', 1*c*').

4. An apparatus as claimed in claim 1, characterized in that the screen (1; 1') is a disk screen.

5. An apparatus as claimed in claim 1, characterized in that the screen (1") is a flat screen.

6. An apparatus as claimed in claim 1 characterized in that a profiling (P) of the rolls (6*a*, 6*b*) of at least one chip compressor (6) is wavy.

* * * * *